United States Patent [19]

Nishikawa et al.

[11] 4,141,650

[45] Feb. 27, 1979

[54] IMPROVED SHUTTER APPARATUS FOR ELECTROPHOTOGRAPHIC APPARATUS

[75] Inventors: Masaji Nishikawa; Kiyoshi Miyashita, both of Hachioji, Japan

[73] Assignee: Olympus Optical Company Limited, Tokyo, Japan

[21] Appl. No.: 808,433

[22] Filed: Jun. 20, 1977

[30] Foreign Application Priority Data

Jun. 24, 1976 [JP] Japan ..... 50/73786

[51] Int. Cl.[2] ..... G03G 15/00

[52] U.S. Cl. ..... 355/35 C; 355/8; 355/71

[58] Field of Search ..... 355/35 C, 3 R, 71, 67, 355/8, 11

[56] References Cited

U.S. PATENT DOCUMENTS

| | | | |
|---|---|---|---|
| 3,438,704 | 4/1969 | Schoen | 355/8 |
| 3,713,734 | 1/1973 | Crane et al. | 355/35 C |
| 3,762,811 | 10/1973 | Matsumoto | 355/3 R |
| 4,046,466 | 9/1977 | Ando et al. | 355/35 C |

*Primary Examiner*—R. L. Moses

*Attorney, Agent, or Firm*—Haseltine, Lake & Waters

[57] ABSTRACT

An electrographic apparatus for producing, on a dielectric record sheet, an electrostatic charge image corresponding to a manuscript image to be recorded is disclosed. The apparatus comprises a shutter arranged in a light path for projecting the manuscript image onto a photosensitive screen and adapted to be opened only when an electrostatic latent image corresponding to the manuscript image is produced on the photosensitive screen.

12 Claims, 1 Drawing Figure

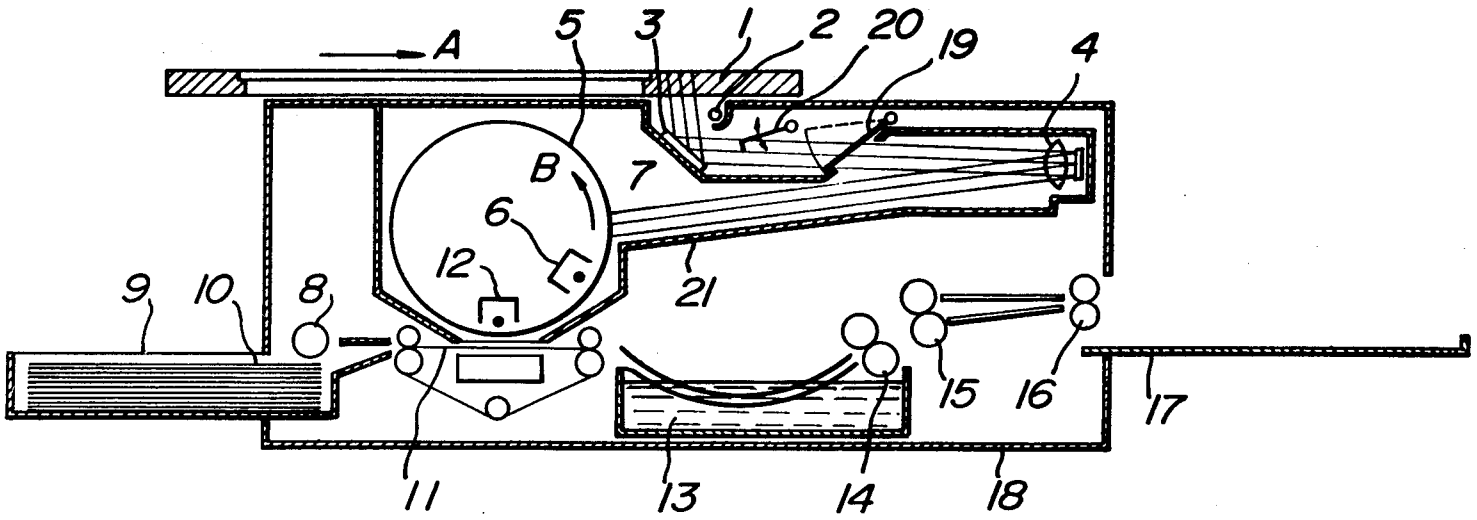
A
B
1
2
3
4
5
6
7
8
9
10
11
12
13
14
15
16
17
18
19
20
21

IMPROVED SHUTTER APPARATUS FOR ELECTROPHOTOGRAPHIC APPARATUS

This invention relates to an electrographic apparatus for producing, on a dielectric record sheet, an electrostatic charge image corresponding to a manuscript image to be recorded.

Various kinds of electrographic apparatus have been well known.

These conventional electrographic apparatus make use of a photosensitive screen. The photosensitive screen is uniformly charged and then exposed and scanned by a manuscript image to produce thereon a first electrostatic latent image. The first electrostatic latent image is transferred onto a dielectric record sheet by modulating a flow of ions directed toward the photosensitive screen and the dielectric record sheet to produce a second electrostatic latent image on the dielectric record sheet.

Such conventional electrographic apparatus have the advantage that a plurality of copies can be obtained on the basis of the first electrostatic latent image produced on the photosensitive screen by one exposing and scanning process. As a result, in the case of obtaining a plurality of copies, after the first electrostatic latent image has been produced on the photosensitive screen, it is possible to omit the succeeding exposing and scanning steps and a mechanism for reciprocating a manuscript carriage or a light source to perform the succeeding exposing and scanning steps. For this purpose, the electrostatic latent image produced on the photosensitive screen by the one exposure must efficiently be held for a long time.

The photosensitive screen may be of a four layers construction which is composed of a electrically conductive layer, an insulating layer, an electrically conductive layer and a photoconductive layer superimposed one upon the other. In such kind of photosensitive screen, the electrostatic latent image is produced on the photoconductive layer thereof. As a result, if the photosensitive screen is exposed to light again after the electrostatic latent image has been produced on the photoconductive layer thereof, the latent image of the manuscript produced on the photoconductive layer becomes decayed or eliminated. During the step of transferring the electrostatic latent image produced on the photosensitive screen onto the dielectric record sheet, in the case of changing a manuscript placed on a manuscript carriage by another manuscript, if the manuscript carriage is not sufficiently covered against the exterior light, the exterior light causes the electrostatic latent image produced on the photosensitive screen to decay or eliminate, and as a result, it is impossible to sufficiently shorten the total copying time.

An object of the invention, therefore, is to provide an electrographic apparatus which makes use of a photosensitive screen for producing an electrostatic latent image on a photoconductive layer thereof and which can open a light path during a step of producing a manuscript latent image on the photosensitive screen and can obscure the light path at times other than the above mentioned step, whereby the manuscript latent image produced on the photosensitive screen is effectively held.

A feature of the invention is the provision of an electrographic apparatus for practicing a step of projecting a manuscript image through a projection lens onto a photosensitive screen to produce, on said photosensitive screen, a first electrostatic latent image corresponding to said manuscript image and a step of modulating a flow of corona ions directed toward said photosensitive screen and a dielectric record sheet to produce, on said dielectric record sheet, a second electrostatic latent image, said apparatus comprising a shutter arranged in a light path for projecting said manuscript image onto said photosensitive screen and adapted to be opened only when said first electrostatic latent image is produced on said photosensitive screen.

As a result, the invention is capable of changing a manuscript placed on a manuscript carriage to another manuscript to ready for the next copying process even during intervals of time at which the manuscript is placed on the carriage, producing the manuscript latent image on the photosensitive screen and obtaining a plurality of copies on the basis of the manuscript latent image.

The invention will now be described in greater detail with reference to the accompanying drawing, wherein:

A single FIGURE is a schematic view of one embodiment of an electrographic apparatus according to the invention:

In a single FIGURE is shown an embodiment of an electrographic apparatus according to the invention. A photosensitive screen 5 is of a four layers construction. Provision is made of a copy button (not shown). When the copy button is closed, a manuscript carriage 1 is forwardly moved in a direction shown by an arrow A and an illumination lamp 2 is lighted up. A manuscript (not shown) placed on the carriage 1 is illuminated with a light emitted from the lamp 2. The light reflected by a reflecting mirror 3 is illuminated through a projection lens 4 onto the screen drum 5. The screen drum 5 is rotated in a direction shown by an arrow B in synchronism with scanning of the manuscript placed on the carriage 1. In this case, a first corona discharge device 6 arranged near the inner periphery of the screen drum 5 functions to uniformly charge the screen drum 5. If a picture image of the manuscript is projected through a light image projection area 7 onto the screen drum 5, a first electrostatic latent image corresponding to the manuscript is produced on the photoconductive layer on the outer periphery of the screen drum 5.

At the end of the step of producing the first electrostatic latent image, the manuscript carriage 1 is began to backwardly move and at the same time a second rotation of the screen drum 5 is started. In this case, the illumination lamp 2 is extinguished. A record sheet feed roller 8 becomes operative in association with the second rotation of the screen drum 5 to deliver a record sheet 10 enclosed in a record sheet cassette 9 onto a conveyer belt 11. If the record sheet 10 delivered on the conveyer belt 11 arrives at a position directly below a second corona discharge device 12 arranged near the inner periphery of the screen drum 5, the second corona discharge device 12 functions to effect a second charge for charging the screen drum 5 with a polarity reverse to that of the first charge, and as a result, the first electrostatic latent image produced on the screen drum 5 is transferred to the record sheet 10 so as to produce a second electrostatic latent image thereon.

The second electrostatic latent image transferred to the record sheet 10 is delivered through a developing device 13, a squeeze roller 14, a sucking roller 15 and an outlet roller 16 to a copy receiving table 17, thereby obtaining a visible picture image on the record sheet 10.

In the case of obtaining a plurality of copies on the basis of the first electrostatic latent image produced by the one exposure and scanning, the step of producing the second electrostatic latent image by the second rotation of the screen drum 5 may only be effected by rotating the screen drum 5 by a desired number of rotations depending on the number of copies to be obtained.

Reference numeral 18 designate a casing. The above mentioned sequence of successive steps of obtaining copies may automatically be controlled.

In accordance with the invention, in the light path for projecting the manuscript image onto the screen drum 5 is arranged a shutter. The shutter may be located at any position in the above mentioned light path.

In the embodiment shown in the drawing, between the reflecting mirror 3 and the projection lens 4 is arranged a shutter 19. In addition, between the shutter 19 and the reflecting mirror 2 is also arranged a throttle plate 20. The throttle plate 20 is operated from the outside and adapted to adjust the amount of exposed light to any value in response to a kind of manuscript and desired concentration of the picture image to be copied.

If the light path between the reflecting mirror 3 and the projection lens 4 is obstructed by the shutter 19, the shutter 19 functions to close a dark box 21 for surrounding the screen drum 5 and the projection lens 4 and having an opening located at the first electrostatic latent image transferring portion.

The shutter 19 may be interlocked, for example, with the reciprocal motion of the manuscript carriage 1 such that the shutter 19 is open only during the forward movement of the manuscript carriage 1 in the direction shown by an arrow A, that is, during intervals of time at which the manuscript is scanned to produce the first electrostatic latent image on the screen drum 5, and that the shutter 19 is closed during the backward movement of the manuscript carriage 1, that is, during intervals of time at which the second electrostatic latent image is produced on the record sheet 10. Alternatively, the shutter 19 may be opened and closed in association with lighting and extinguishing operations of the illumination lamp 2. In the case of obtaining a plurality of copies by only one exposure of light, during rotations succeeding to the second rotation of the screen drum 2, the shutter 19 is always closed, so that there is no risk of the electrostatic latent image produced on the screen drum 5 being decayed or eliminated. The shutter 19 may electromagnetically or mechanically be opened and closed.

As stated hereinbefore, in accordance with the invention, provision is made of the shutter arranged in the light path for projecting the manuscript image onto the photosensitive screen and adapted to be opened during intervals of time at which the first electrostatic latent image is produced on the photosensitive screen and closed during the other intervals of time. As a result, even in the step of producing the second electrostatic latent image on the record sheet, the manuscript placed on the carriage can be changed into another manuscript without decaying or eliminating the first electrostatic latent image produced on the screen drum.

The invention is not limited to the above described embodiment, but many alternations and modifications may be made.

For example, the throttle plate 20 for adjusting the amount of exposure of light from the outside may be omitted and the shutter 19 itself may be made open to a necessary extent as soon as the scanning of the manuscript is started and fully closed at the end of the scanning. In this case, the shutter 19 functions as the throttle plate for determining the amount of exposed light and also as the shutter after the first electrostatic latent image has been produced on the screen drum. In the above described embodiment, the shutter 19 is of a flatter type. Alternatively, the shutter 19 may be of any other types such as a slide type.

What is claimed is:

1. An improved electrographic apparatus for producing a first electrostatic latent image corresponding to a manuscript image on a photosensitive screen and a second electrostatic latent image on a dielectric record sheet, said apparatus employing manuscript carriage means having a manuscript placed thereon; a photosensitive screen; a light source whose radiation is directed along a light path; reflecting mirror and projection lens for projecting said manuscript image onto said photosensitive screen; first and second corona discharge devices adapted to direct a flow of corona ions toward said photosensitive screen and through said photosensitive screen toward said dielectric record sheet, respectively, the improvement comprising: a shutter arranged in said light path and interlocked with said manuscript carriage, said shutter being adapted to open only during intervals of time at which said manuscript is scanned to produce said first electrostatic latent image on said photosensitive screen and said shutter being adapted to close during intervals of time at which said second electrostatic latent image is produced on said dielectric record sheet.

2. The apparatus according to claim 1 and comprising means for adjusting the amount of exposed light passing through said shutter when said first electrostatic latent image is produced on said photosensitive screen.

3. The apparatus according to claim 1 wherein said shutter is of a flutter type.

4. The apparatus according to claim 1 wherein said shutter is of a slide type.

5. The apparatus according to claim 1 wherein said shutter is arranged in said light path passing from a reflecting mirror to said projection lens.

6. The apparatus according to claim 1 wherein said shutter is associated with lighting and extinguishing operation of an illumination lamp.

7. The apparatus according to claim 1 wherein said shutter is electromagnetically opened and closed.

8. The apparatus according to claim 1 wherein said shutter is mechanically opened and closed.

9. The apparatus according to claim 2 wherein said means for adjusting the amount of exposed light passing through said shutter is composed of said shutter per se.

10. The apparatus according to claim 2 wherein said mean for adjusting the amount of exposed light passing through said shutter is composed of a throttle plate arranged between said shutter and a reflecting mirror.

11. The apparatus according to claim 10 wherein said throttle plate is operated from the outside and adapted to adjust the amount of exposed light to any value in response to a kind of manuscript and desired concentration of a picture image to be copied.

12. The apparatus according to claim 1 wherein said photosensitive screen and said projection lens are surrounded by a dark box except said shutter and that part of said photosensitive screen through which said first electrostatic latent image is transferred to said dielectric record sheet.

* * * * *